United States Patent [19]

Anthony et al.

[11] 4,279,667

[45] Jul. 21, 1981

[54] ZIRCONIUM ALLOYS HAVING AN INTEGRAL β-QUENCHED CORROSION-RESISTANT SURFACE REGION

[75] Inventors: Thomas R. Anthony, Schenectady, N.Y.; Harvey E. Cline, Stanford, Calif.

[73] Assignee: General Electric Company, Schenectady, N.Y.

[21] Appl. No.: 972,388

[22] Filed: Dec. 22, 1978

[51] Int. Cl.[3] ..... C22C 16/00; C22F 1/18

[52] U.S. Cl. ..... 148/32; 75/177; 148/39; 148/133

[58] Field of Search ..... 148/4, 11.5 F, 32, 39, 148/133, 1; 75/177; 176/91 R

[56] References Cited

U.S. PATENT DOCUMENTS

| | | | |
|---|---|---|---|
| 3,505,126 | 4/1970 | Antes | 148/1 |
| 3,664,825 | 5/1972 | Bergqvist et al. | 75/177 |
| 3,865,635 | 2/1975 | Hofvenstam et al. | 148/11.5 F |
| 4,122,240 | 10/1978 | Banas et al. | 148/39 |

FOREIGN PATENT DOCUMENTS

| | | | |
|---|---|---|---|
| 2134662 | 1/1973 | Fed. Rep. of Germany | 148/39 |

OTHER PUBLICATIONS

Van Cleave, "Lasers Permit Precision Surface Treatments", *Iron Age*, Jan. 31, 1977, pp. 25–27.

"Laser Right on the Beam for Heat Treating Duty", *Iron Age*, Feb. 10, 1975, pp. 45–47.

"Surface Hardening and Alloying with a Laser Beam System", *Industrial Heating*, Jul. 1974, pp. 19–25.

*Primary Examiner*—L. Dewayne Rutledge
*Assistant Examiner*—Peter K. Skiff
*Attorney, Agent, or Firm*—Stephen S. Strunck; James C. Davis, Jr.; Leo I. MaLossi

[57] ABSTRACT

A body composed of a zirconium alloy is afforded enhanced corrosion resistance to a high pressure and high temperature steam environment by an integral surface region of β-quenched zirconium formed in situ by laser beam scanning and afforded good mechanical and structural properties by the underlying bulk region whose metallurgical structure is selected to optimize these mechanical properties.

8 Claims, 3 Drawing Figures

ZIRCONIUM ALLOYS HAVING AN INTEGRAL β-QUENCHED CORROSION-RESISTANT SURFACE REGION

BACKGROUND OF THE INVENTION

1. Field of the Invention

This invention relates to the integral β-quenched surface regions formed in situ on bulk structures of zirconium alloys by laser beam scanning.

2. Description of Prior Art

Zirconium alloys are now widely accepted as cladding and structural materials in water-cooled, moderated boiling water and pressurized water nuclear reactors. These alloys combine a low neutron absorption cross section with good corrosion resistance and adequate mechanical properties.

The most common zirconium alloys used up to now are Zircaloy-2 and Zircaloy-4. The nominal compositions of these alloys are given in Table 1.

TABLE I

| Zircaloy-2 | |
|---|---|
| Element | Weight |
| Sn | 1.2–1.7 |
| Fe | 0.07–0.20 |
| Cr | 0.05–0.15 |
| Ni | 0.03–0.08 |
| Zr | Balance |
| **Zircaloy-4** | |
| Element | Weight % |
| Sn | 1.2–1.7 |
| Fe | 0.18–0.24 |
| Cr | 0.07–0.13 |
| Zr | Balance |

In addition to Zircaloy-2 and Zircaloy-4, considerable amount of experimental work and some nuclear work has been done on Zr+15% Nb+0–1% X alloys where X is usually a transition metal.

In general, these materials have proved adequate under nuclear reactor operating conditions. The fuel element design engineer would like a cladding material that is more resistant to high temperature aqueous corrosion while maintaining an adequate mechanical strength.

During manufacture of Zircaloy channels, a seam in the channels is welded together. It has been observed that this seam weld is substantially more resistant to accelerated nodular corrosion than the rest of the unwelded channel. In addition, other work in the literature has shown that accelerated nodular corrosion in a high temperature, high pressure steam environment can be inhibited by β-phase heat treatments which are similar to the effect derived when the welded seams cool down through the β-phase region immediately after welding.

The exact reason for the enhanced resistance of β-quenched Zircaloy to accelerated nodular corrosion in a high temperature, high pressure steam environment is not understood completely. It appears, however, that this enhanced corrosion resistance is related to the fine equiaxed grain structure and to the fine dispersion of iron, nickel and chromium intermetallics in β-quenched Zircaloy. The effect of β-quenching on the metallurgical structure of Zircaloy stems from the fact that β is the high temperature phase of Zircaloy that is not stable below 810° C. and the fact that iron, nickel and chromium are β-stabilizers that partition preferentially to the β phase.

Referring now to FIG. 1, if a Zircaloy sample is held in the α+β phase region that ranges between 810° C. to 970° C., the Zircaloy transforms to a two phase mixture of α and β grains. Iron, nickel and chrome being β-stabilizers will segregate to the β phase grains. On cooling the Zircaloy sample from this two phase region through the boundary between the α+β and α regions into the α region, the β phase decomposes precipitating fine grains of α-zirconium and rejecting the iron, nickel and chrome intermetallics on the adjacent grain boundaries of the newly formed α grains. The resulting metallurgical structure of the Zircaloy is thus a fine grained α structure with a fine dispersion of iron, nickel and chromium intermetallics distributed therein. A similar metallurgical structure can be achieved by quenching directly from the β-phase region about 970° C. This heat treatment results in a very fine grain α "basket weave" structure with a fine distributionof iron, nickel and chromium intermetallics dispersed therein. This latter heat treatment parallels the thermal history of a weld on cooling and results in a metallurgical structure with enhanced resistance to accelerated nodular corrosion in high pressure, high temperature steam. Not only do the Zircaloys, but also Zr+15%Nb+0–1%X (where X is usually a transition metal) alloys exhibit enhanced corrosion resistance in the β-quenched condition. Such a β-quench or α+β quench is not always feasible for bulk Zircaloy pieces because forming operations, mechanical property requirements, and the generation of large thermal stresses or large thermal distortions in a bulk Zircaloy body may prevent such a quenching operation. In such cases, other ways must be found to prevent the accelerated nodular corrosion of Zircaloy that occurs in steam at high pressures and temperatures.

Accelerated corrosion of Zircaloy-2 and Zircaloy-4 has been observed under boiling water nuclear reactor conditions and appears to initiate at localized spots and spreads across the Zircaloy surface by lateral growth such that in the initial stages of growth these thick light-colored oxide nodules appear like islands on a thin homogeneous dark oxide background. This accelerated corrosion process that occurs in high-temperature, high-pressure steam can be inhibited metallurgically by quenching Zircaloy from its high temperature body centered cubic β form. β-quenched Zircaloy tends to form a thin coherent protective oxide in a high temperature (500° C.) and a high pressure (100 atm) steam environment, that is substantially more resistant to the in-reactor corrosion than Zircaloy that has not received a β-phase heat treatment.

Unfortunately, a β-phase heat treatment reduces the mechanical strength of Zircaloy and markedly increases the strain rate at which strain rate sensitivities indicative of superplasticity are observed. This high strain rate sensitivity and lower strength is caused by grain boundary sliding on a greatly increased grain boundary area due to a finer grain size in β-quenched Zircaloy. Because of these mechanical deficiencies, bulk β-quenched Zircaloy is not particularly desirable for use as cladding and structural materials for water-cooled nuclear reactors.

Despite the potential detrimental effect of β-quenching on the mechanical properties of Zircaloy, bulk β-quenching of Zircaloy channels for nuclear reactors has been commercialized because of the superior corrosion resistance of β-quenched Zircaloy. This commercial process consists of passing a Zircaloy channel through an induction heater to heat the channel into the two phase $\alpha+\beta$ region. The channel is subsequently rapidly quenched by spraying water on the hot channel. Although this induction-heating-water-spray process imparts the desired corrosion resistant properties to the Zircaloy channel, it suffers from several deficiencies.

First, the exposure of the Zircaloy channel to oxygen and water during the induction heating and water quenching allows a thick black oxide to form on the channel that subsequently must be removed. This removal step adds to the manufacturing cost of the channel.

Secondly, although it is only necessary to heat treat the surface layers of the channel, the current commercial process exposes the entire channel bulk to the heat treatment required only by the surface layers. The resulting change in mechanical properties of the channel under long term creep conditions may not be desirable.

It is therefore desirable to have a new type of $\beta$-quenched Zircaloy that can be used in circumstances where bulk $\beta$-quenched Zircaloy can not be used because of its deficient mechanical properties, because of the formation of black scale on its surface and/or because of thermal distortions and thermal stresses such bulk quenching would generate.

An object of this invention is to provide a new and improved zirconium alloy with an integral $\beta$-quenched surface region, the composite structure of which overcomes the deficiencies of the prior art.

Another object of this invention is to provide a new form of a zirconium alloy that can be utilized in circumstances where a bulk $\beta$-quenched zirconium alloy cannot be used.

Another object of this invention is to provide an integral protective, corrosion-resistant surface region on a zirconium alloy body.

Another object of this invention is to provide a body of zirconium alloy with an integral surface region of $\beta$-quenched material formed in situ by heating and rapidly self-quenching the material of the surface region.

Other objects of this invention will, in part, be obvious and will, in part, appear hereafter.

BRIEF DESCRIPTION OF THE INVENTION

In accordance with the teachings of this invention, there is provided a body having a core of zirconium alloy such as Zircaloy-2. An integral outer surface region of $\beta$-quenched zirconium alloy encompasses the core to impart corrosion resistance to the zirconium alloy article in a high pressure and high temperature steam environment where enhanced nodular corrosion of the zirconium alloy article would otherwise occur.

The microstructure of the material of the body has the metallurgical structure resulting from the normal forming and heat treating operations required to make this article with a given structure and mechanical strength. The integral outer surface region of the article has a $\beta$-quenched structure consisting of a very fine grained "basket weave" structure of hexagonal close-packed grains with a fine distribution of iron, nickel, chromium, and/or other transition metal intermetallics dispersed therein.

The physical structure of the integral outer surface region of $\beta$-quenched zirconium alloy consists of a series of mutually overlapping integral scallop shaped regions. The thickness of the $\beta$-quenched outer region typically has a minimum thickness of about $1.25\times10^{-1}$ cm and may be up to 10 millimeters.

DESCRIPTION OF THE INVENTION

We have discovered that by scanning a laser beam over the surface of a body of Zircaloy, a thin layer continguous to the surface is first heated to a temperature where the $\beta$ phase is formed and then rapidly self-quenched, forming a barrier of $\beta$-quenched Zircaloy at the surface.

Figure 1:
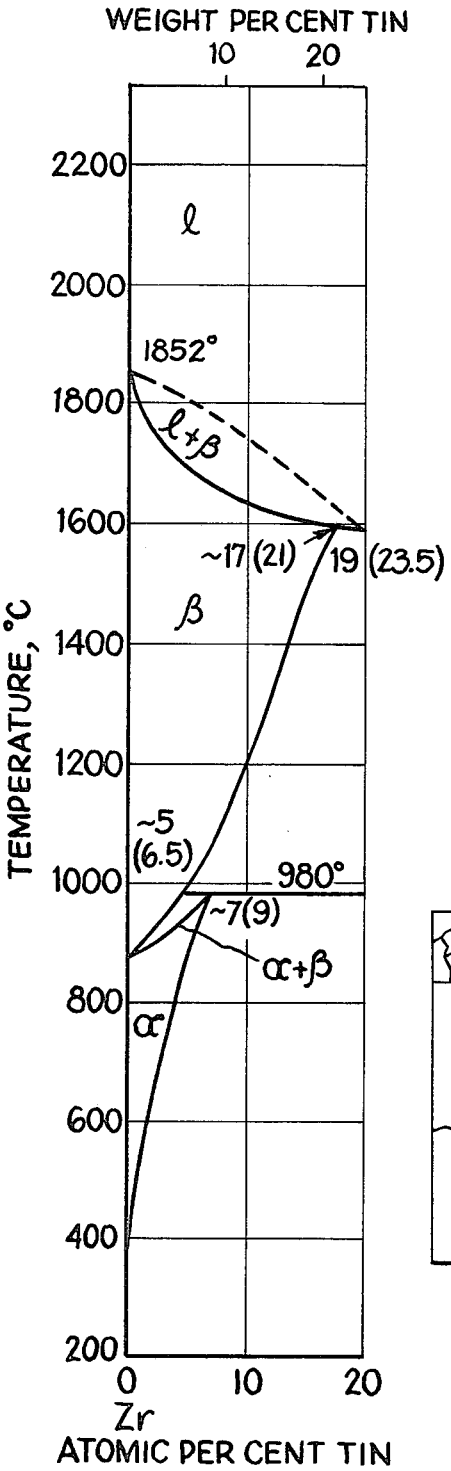
FIG. 1 is the equilibrium phase diagram of zirconium and tin. Tin is the major alloy addition to zirconium that produces Zircaloy. In the range of interest from 1.2 to 1.7 wt%Sn, Zircaloy has three phases in the temperature range indicated; namely, the hexagonal close-packed $\alpha$ phase, the body centered cubic $\beta$ phase, and the liquid l phase.
Figure 2:
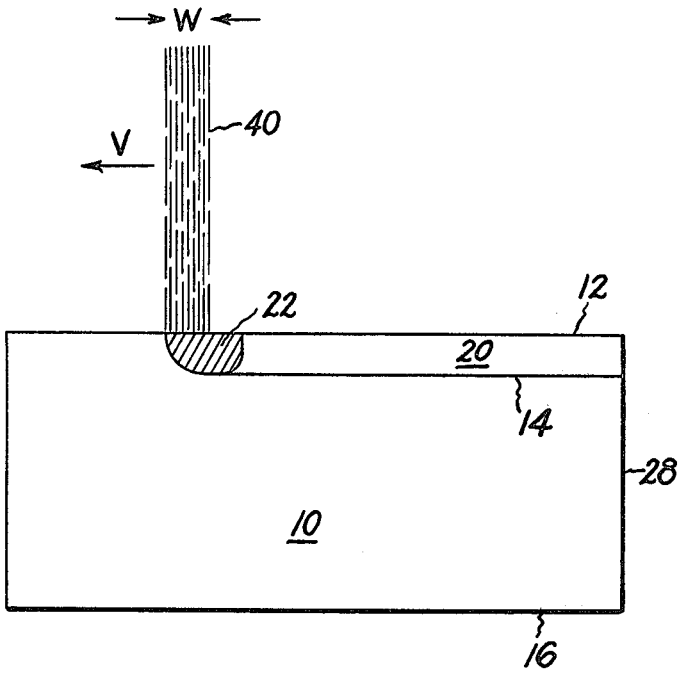
FIG. 2 is a schematic illustration of laser processing of a Zircaloy slab.

Referring now to FIG. 2, there is shown a slab-like body 10 of Zircaloy undergoing laser $\beta$-quenching. A laser beam 40 impinges on the surface 12 of the Zircaloy body 10 forming a region 22 that is heated into the temperature range where $\beta$ grains of Zircaloy nucleate and grow. The laser beam scans across the surface 12 of body 10 with a velocity V. Immediately behind the moving heated region 22 of body 10, the Zircaloy self-quenches forming a path 20 of $\beta$-quenched Zircaloy across the surface 12 of the zirconium alloy body 10.

Although an electron beam or a flame may be employed in practicing this invention, the preferred method is the utilization of a laser beam. Presently, it is the most economical of the methods suggested and furthermore, it does not require the use of a vacuum chamber.

The overlapping passes across the workpiece necessary to achieve the end result can be accomplished in several ways. The workpiece, the beam or both can be moved in an X-Y direction to provide the necessary relative translation. Additionally, an optical system may be employed to scan the workpiece and process the surface region as required.

The power of the laser beam 40 is sufficient at the given laser beam scan rate V to form a region 22 of predetermined depth that is heated into the temperature range where $\beta$ grains form. The rapidly $\beta$-quenched material 20 in the surface of layer 12 of body 10 resists accelerated nodular corrosion in a high pressure, high temperature steam environment.

In order for the heated surface region 22 to form $\beta$ grains, sufficient time must elapse at high temperatures for $\beta$ grain nucleation and growth to take place. If $\delta$ is the radius of the heated zone 22 beneath the laser beam 40 moving at a velocity V, then the time $\tau$ that the surface layer is heated is $$\tau = \frac{2\delta}{V} \tag{1}$$

The time required for the nucleation of $\beta$ grains, $\tau_N$, and the time $\tau_G$ required for the growth of these $\beta$ grains to a size L at a grain growth velocity $V_G$ is $$\tau_{total} = \tau_N + \tau_G = \tau_N + L/V_G \quad (2)$$

From equation (1) and (2) and the condition that $\tau > \tau_{total}$, the maximum laser-scan velocity $V_{max}$ with which $\beta$-quenching will still occur is $$V_{max} \leqq \frac{2V_G\delta}{(V_G\tau_N + L)} \quad (3)$$

Taking values of $V_G = 2 \times 10^{-3}$ cm/sec, $\delta = 2$ cm, $L = 10^{-4}$ cm and $\tau_N = 10^{-1}$ sec gives the maximum laser-scan velocity capable of $\beta$-quenching the surface layer of Zircaloy of 26 cm/sec for the 2 cm size of the heated zone 22. L, $V_G$ and $\tau_N$ are intrinsic properties of the Zircaloy material and cannot be varied. However, the size $\delta$ of the heated zone 22 can be varied at will be varying the width W of the laser beam 40. By varying the width W of the laser beam 40, the maximum scan rate $V_{max}$ of the laser can also be varied.

As shown above, a maximum critical laser-scan velocity exists above which there will not be time for $\beta$ grains to form in the heated zone 22. In addition, there is a minimum critical laser-scan velocity $V_{min}$ below which the desired metallurgical structure of Zircaloy will not form because of too slow a cooling rate. The physical cause of the maximum laser-scan velocity limit was the time required in the heated zone for $\beta$ grain nucleation and growth. On the other hand, the physical cause of the minimum laser-scan velocity limit is the minimum quench rate required to form the $\beta$-quenched metallurgical structure of Zircaloy that is resistant to accelerated nodular corrosion in a high pressure and high temperature steam environment.

The quench rate $\partial T/\partial t$ of Zircaloy in the surface zone 20 behind the moving laser beam 40 is given by $$\frac{\partial T}{\partial t} = \overline{V} \cdot \overline{\nabla T}$$

where $\overline{\nabla T}$ is the temperature gradient in the Zircaloy. If the laser beam is moving in the X direction, by dimensional analysis, the time-averaged temperature gradient dT/dX at a point in the specimen with temperature T is, $$\frac{dT}{dX} = \frac{V_x}{D_T} T$$

where Vx is the laser-scan velocity, T is the temperature and $D_T$ is the thermal diffusion constant of Zircaloy. The combination of equations (4) and (5) can be solved for the minimum critical laser scan velocity $V_{min}$ that will give the minimum required quench rate $(\partial T/\partial t)_{min}$ $$V_{min} \geqq \left[\frac{2D_T}{T_B}\left(\frac{-\partial T}{\partial t}\right)_{min}\right]^{\frac{1}{2}}$$

where $T_B$ is the temperature at the $\alpha$ to $\alpha+\beta$ phase boundary in Zircaloy. Substituting the values of $T_B = 810°$ C., $D_T = 0.6$ cm²/sec and $(-\partial T/\partial t)_{min} = 15°$ C./sec, the minimum laser-scan velocity $V_{min}$ for $\beta$-quenching Zircaloy is about $1.4 \times 10^{-1}$ cm/sec. This value compares with a maximum permissible laser-scan velocity of 26 cm/sec required to form the $\beta$ grains beneath the laser beam. Thus, there is only a two order-of-magnitude range in laser-scanning rates which are compatible with surface $\beta$-quenching Zircaloy by laser surface heating in order to make the Zircaloy resistant to accelerated nodular corrosion in a high pressure and high temperature steam environment.

Figure 3:
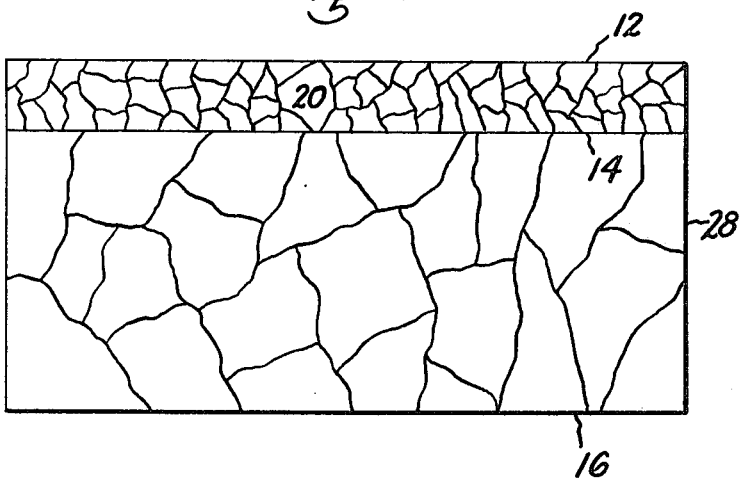
FIG. 3 is a schematic illustration of a laser-processed zirconium alloy slab showing the surface heated and $\beta$-quenched region with the contiguous unheated $\alpha$ region below.

Referring now to FIG. 3, a body of Zircaloy 10 with top and bottom surfaces 12 and 16, respectively, and side faces 28 is shown after laser surface $\beta$-quenching. Zone 20 of Zircaloy body 10 is a "basket weave" fine grained $\alpha$ Zircaloy containing a very fine dispersion of intermetallics of iron, nickel and chromiun resulting from surface $\beta$-quenching. The thickness or depth of zone 20 may be up to 10 millimeters. The bulk of body 10 is left in its original metallurgical condition with its larger $\alpha$-grains and less finely distributed dispersion of intermetallics. The metallurgical structure of the bulk of body 10 has been chosen by those skilled in the art to provide the best mechanical and structural properties for its ultimate use in a reactor. The $\beta$-quenched surface region 20, on the other hand, has been formed principally to resist accelerated nodular corrosion in a high pressure and high temperature steam environment. The composition structure consisting of the $\beta$-quenched surface region 20 and the Zircaloy bulk presents a metallurgical structure with excellent mechanical, structural and corrosion-resistant properties.

We claim as one invention:

1. An article of manufacutre comprising a body of zirconium alloy having a composite microstructure including:

a core having a first microstructure selected to maximize the physical structure and mechanical properties of said article, and an integral outer surface region encompassing said core to a depth in the range of from about $1.25 \times 10^{-2}$ cm to 1 cm having a second microstructure of $\beta$-quenched zirconium alloy to impart enhanced corrosion resistance to said article in a high temperature and high pressure steam environment.

2. The article of claim 1 wherein:

the physical structure of the integral outer surface region of the $\beta$-quenched zirconium alloy consists of mutually overlapping scallop shaped regions.

3. the article of claim 1 wherein:

said second microstructure of said integral outer surface region is a fine grain, basket-weave $\alpha$ grain structure with a uniform distribution of fine transition metal intermetallics dispersed therein.

4. The article of claim 3 wherein:

said transition metal is at least one selected from the group of metals consisting of iron, nickel, chromium, vanadium and tantalum.

5. The article of claim 1 wherein:

said zirconium alloy is Zircaloy-2 whose composition by element and weight percent is as follows:

| | |
|---|---|
| Sn | 1.2–1.7 |
| Fe | 0.07–0.20 |
| Cr | 0.05–0.15 |
| Ni | 0.03–0.08 |
| Zr | Balance |

6. The article of claim 1 wherein:

said zirconium alloy is Zircaloy-4 whose composition by element and weight percent is as follows:

| | |
|---|---|
| Sn | 1.2–1.7 |
| Fe | 0.18–0.24 |
| Cr | 0.07–0.13 |
| Zr | Balance |

7. The article of claim 1 wherein:

said zirconium alloy has a composition of element and weight percent as follows:

| | |
|---|---|
| Nb | 15 |
| X | 0–1 |
| Zr | Balance |

wherein

X is at least one transition metal.

8. The article of claim 3 wherein:

said first microstructure of said core consists of an $\alpha$ grain structure larger in size than said basket-weave $\alpha$ grain structure of said integral outer surface region and having fine transition metal intermetallics which are less uniformly distributed therein than in said second microstructure of said integral outer surface region.

* * * * *